US005959271A

United States Patent [19]

Matsuhashi

[11] Patent Number: 5,959,271

[45] Date of Patent: Sep. 28, 1999

[54] STOPPING DEVICE WITH A SWITCH

[75] Inventor: Akira Matsuhashi, Tokyo, Japan

[73] Assignee: Metrol Co., Ltd., Tokyo, Japan

[21] Appl. No.: 09/076,871

[22] Filed: May 13, 1998

Related U.S. Application Data

[63] Continuation-in-part of application No. 08/831,352, Apr. 1, 1997.

[51] Int. Cl.[6] ..... H01H 3/16

[52] U.S. Cl. ..... 200/61.41; 200/61.73

[58] Field of Search ..... 200/16 R, 16 B, 200/16 C, 47, 61.41–61.43, 61.62, 61.71, 61.73, 61.74, 61.76, 61.81, 302.1, 302.2

[56] References Cited

U.S. PATENT DOCUMENTS

| | | | |
|---|---|---|---|
| 2,451,176 | 10/1948 | Schellman | 200/168 |
| 2,822,436 | 2/1958 | Towle | 200/61.41 |
| 2,921,155 | 1/1960 | Basso | 200/61.82 |
| 3,190,982 | 6/1965 | Woodcock | 200/61.81 |
| 3,244,829 | 4/1966 | Webb | 200/61.62 |
| 3,940,585 | 2/1976 | Schaad | 200/159 R |
| 5,412,168 | 5/1995 | McKelvey et al. | 200/61.41 |

*Primary Examiner*—Michael A. Friedhofer
*Attorney, Agent, or Firm*—Kanesaka & Takeuchi

[57] ABSTRACT

A stopping device with a switch of the invention includes a bolt with a head portion, a control signal generating device situated in a bolt through hole of the bolt, and a sliding member. The sliding member includes a shaft slidably situated in the head through hole, a flange attached to the shaft and having a second stopping face facing a first stopping face of the head portion, and an end portion extending from the flange to contact an object to be detected. After the object contacts the end portion, until the second stopping face abuts against the first stopping face, the control signal generating device produces a control signal. A sealing device is installed between the head portion and the sliding member. Thus, dustproof and waterproof effects can be obtained.

7 Claims, 4 Drawing Sheets

STOPPING DEVICE WITH A SWITCH

CROSS-REFERENCE TO RELATED APPLICATION

This is a continuation-in-part application of Ser. No. 08/831,352 filed on Apr. 1, 1997.

BACKGROUND OF THE INVENTION AND RELATED ART STATEMENT

The present invention relates to a stopping device with a stopper switch formed of, in combination, a stopping member for stopping an object to be detected at a predetermined position through abutment with the object, and a switch or control signal generating device for outputting a signal immediately before the object is stopped.

Heretofore, it has been generally carried out that an object to be detected, such as a table on which a work or an article to be measured is mounted, is stopped at a predetermined position by abutting against a stopping member, such as a positioning bolt.

In the above case, it is required to confirm whether an object to be detected abuts against the stopping member, or to switch a movement of the object to a reverse direction. More specifically, FIG. 5 shows a conventional positioning bolt 51, wherein a front end 50 of an object B to be detected is moved in a right direction on the drawing, and immediately before the object B is stopped by abutting against a head of the positioning bolt 51 fixed to a base wall 52, a projection 53 integrally provided at the front end 50 of the object B actuates a limit switch 54 to thereby produce a control signal, such as ON or OFF signal.

In the above structure, the projection 53 for actuating the limit switch 54 has to be provided at the front end 50 of the object B to be detected. Also, it is required that an operating position of the switch is adjusted by moving an attaching position of the limit switch 54 so that the control signal is produced immediately before the front end 50 abuts against the positioning bolt 51. Namely, in addition to the bolt and switch, an adjustment of the switch is required.

In order to simplify the structure and adjustment, the present inventor invented a positioning bolt 61 as shown in FIG. 6, wherein a switch is housed in a space of a central area of the positioning bolt.

In the structure as shown in FIG. 6, a sliding shaft 62 having, at a forward end thereof, a contact 63 for contacting an object to be detected is disposed in a hole provided in a bolt so that the sliding shaft 62 can slidably move in the hole. In this structure, dust, chips, water, cutting oil and the like enter into the hole for the sliding shaft 62, or sometimes further enter into an inner switching portion, so that the positioning bolt does not work properly.

In U.S. Pat. No. 5,412,168, a tool setter for sensing contact with a tool bit has a contact portion with a housing, and a switch. However, the contact portion is not designed to support a large force nor to actuate the switch precisely.

Accordingly, one object of the invention is to provide a stopping device with a switch, wherein a sliding member of the stopping device is properly sealed to provide dustproof and waterproof device.

Another object of the invention is to provide a stopping device with a switch as stated above, wherein a stop position of the switch can be set easily even if the stopping device is exchanged.

A further object of the invention is to provide a stopping device with a switch as stated above, wherein the abutting force of the moving member is properly supported and is not directly transmitted to the switch or control signal generating device.

Further objects and advantages of the invention will be apparent from the following description of the invention.

SUMMARY OF THE INVENTION

A stopping device with a switch of the invention is basically formed of a bolt section, a sliding member, a control signal generating device, and a sealing device. The bolt section includes a bolt having a bolt through hole therein, and a head portion connected to the bolt and having a first stopping face and a head through hole communicating with the bolt through hole. The control signal generating device is situated in the bolt through hole of the bolt portion.

The sliding member includes a shaft slidably situated in the head through hole, a flange attached to the shaft and having a second stopping face facing the first stopping face of the head portion, and an end portion extending from the flange to contact an object to be detected. A spring device is attached to the sliding member to urge the sliding member away from the head portion. In use, the control signal generating device produces a control signal before the second stopping face abuts against the first stopping face after the object contacts the end portion.

The sealing device includes a cylindrical elastic member having a first end attached to the head portion, and a second end attached to the sliding member for sealing between the head portion and the sliding member. The sealing device further includes a cylindrical cover situated over the head portion to securely hold the first end between the head portion and the cover, and a stopper attached to the sliding member near the end portion for holding the second end between the flange and the stopper.

Preferably, the first and second ends of the cylindrical elastic member have thicknesses greater than a middle portion between the first and second ends to sealingly fix the first and second ends to the head portion and the sliding member. The head portion has an annular groove, into which the first end of the cylindrical elastic member is disposed. The second end is held between the flange and the stopper.

In the invention, since the sliding member and the control signal generating device are connected through a contact therebetween, even if the object to be detected abuts against the sliding member, the abutting force is not directly transmitted to the control signal generating device.

Also, indirect stopping surfaces are applied to the second and third stopping faces, so that the surfaces for receiving an abutting force becomes wider. Therefore, there is no risk that breaking and deformation take place between the sliding member and the head.

Preferably, the control signal generating device is constructed as a pushing switch, and includes a cable fixture fixed to the bolt at a side away from the head portion, an insulation cylinder situated in the bolt through hole adjacent the cable fixture, and a switch mechanism situated in the insulation cylinder. The spring device is situated between the insulation cylinder and the sliding member so that when the object to be detected abuts against the sliding member, abutting force thereof is transmitted to the switch mechanism to actuate the switch mechanism.

DETAILED DESCRIPTION OF PREFERRED EMBODIMENTS

Figure 1:
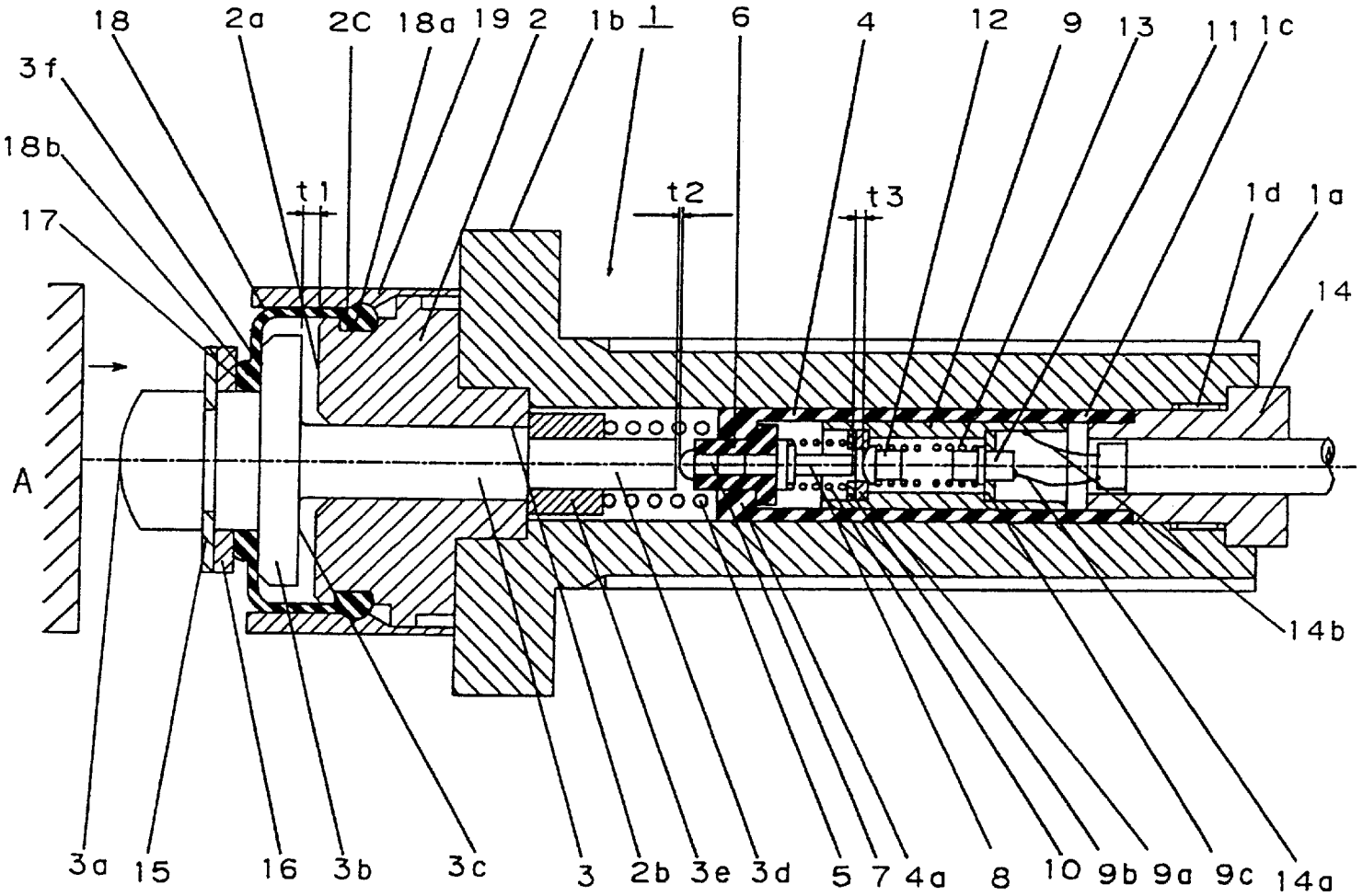
FIG. 1 is a front sectional view of a stopping device with a switch of a first embodiment according to the present invention.

Referring to the drawings, the present invention is described in detail.

Figure 2:
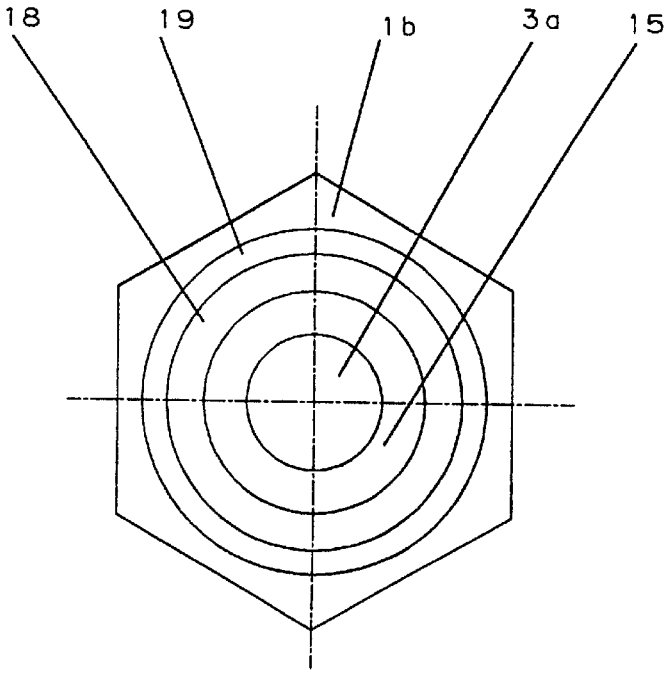
FIG. 2 is a left side view of FIG. 1.

In FIG. 1, reference numeral 1 designates a bolt body having a male thread 1*a* and a tightening portion 1*b* with an outer shape to be rotated by a wrench, such as a hexagon (refer to FIG. 2). A head 2 is formed separately and fixed to the bolt body 1 as one unit. The head 2 has a reference stopping face 2*a* as a stopping face at a left side in FIG. 1, and a through hole 2*b* at a center thereof, into which a sliding shaft or member 3 is slidably inserted.

The sliding shaft 3 has an end 3*a* at a left side in FIG. 1 to form a first stopping face, and a flange 3*b* with a face 3*c* to form a second stopping face parallel to the reference stopping face 2*a*. The sliding shaft 3 also has a right side shaft 3*d*, to which a stop ring 3*e* is fixed.

A coil spring 5 is interposed between the stop ring 3*e* and an insulation conduit 4 disposed loosely in a hole 1*c* formed in the bolt body 1. Thus, the stop ring 3*e* is generally urged by the spring 5 leftwardly in FIG. 1, and is stopped at a right edge of the head 2. In this condition, a space t1 is formed between the reference stopping face 2*a* and the second stopping face 3*c*.

The insulation conduit 4 has a bearing portion 4*a* at a left side in FIG. 1 to slidably receive therein an actuator 6 made of a non-electrical conductive material. The actuator 6 has a contact pin 7 with a semi-spherical head made of hard metal at one end, and a movable contact 8 at the opposite end thereof.

An electrically conductive conduit 9 is fixed inside the insulation conduit 4. An insulation annular member 9*a* is fixed to the conductive conduit 9, and an electrically conductive annular member 9*b* is also fixed outside the annular member 9*a*. A compression coil spring 10 is interposed between the electrically conductive annular member 9*b* and the movable contact 8 to generally urge the actuator 6 leftwardly in FIG. 1.

At the right end of the conductive conduit 9 in FIG. 1, an insulation annular member 9*c* having a terminal 11 therein is fixed. A semi-spherical fixed contact 12 is situated inside the conductive conduit 9, and is urged by a compression coil spring 13 situated between the fixed contact 12 and the terminal 11, so that the fixed contact 12 contacts the insulation annular member 9*a*.

A cable fixture 14 for allowing a cable for lead wires 14*a*, 14*b* to pass therethrough is attached to the insulation conduit 4. The lead wire 14*a* is connected to the terminal 11, and the lead wire 14*b* is connected to the conductive conduit 9. The cable fixture 14 is screwed into a female thread 1d formed inside the hole 1*c* of the bolt body 1. Therefore, when the cable fixture 14 is removed from the thread 1*d*, the insulation conduit 4 loosely disposed in the hole 1*c* can be taken out. Therefore, if necessary, the switch portion can be removed completely to exchange the same.

Incidentally, the head 2 has a groove 2*c* around an outer periphery, and a groove 17 is formed between a left side of the flange 3*b* in FIG. 1 and a metal seat 16 supported by a stop ring 15. A rubber cylindrical cover 18 is disposed between the head 2 and the sliding shaft 3, i.e. between the grooves 2*c*, 17. A dust cover 19 is disposed over the head 2, so that a thick portion 18*a* at one side of the rubber cover 18 is tightly situated inside the groove 2*c*. Also, a thick portion 18*b* at the other end of the rubber cover 18 is tightly situated in the groove 17 defined between the flange 3*b* and the metal seat 16 by the stop ring 15. Thus, the sliding shaft 3 is securely sealed relative to the head 2 by the rubber cover 18.

Next, the operation of the stopping device with the switch of the invention is explained. In the construction as described above, an object A to be detected is moved in a right direction, i.e. an arrow direction, in FIG. 1 to abut against the first stopping face 3*a* of the sliding shaft or member 3. As a result, the sliding shaft 3 is moved rightwardly by being pushed by the object A.

When the object A to be detected is further moved in the right direction together with the moving shaft 3, the right side shaft 3*d* of the sliding shaft 3 contacts the contact pin 7 to move the actuator 6 in the right direction in FIG. 1. Thus, the movable contact 8 contacts the fixed contact 12.

Consequently, a circuit including the lead wire 14*a*, terminal 11, compression coil spring 13, fixed contact 12, movable contact 8, compression oil spring 10, conductive annular member 9*b*, conductive conduit 9 and lead wire 14*b* is formed to thereby send an ON signal to a control circuit, not shown, to confirm that the object A to be detected abuts against the sliding shaft 3, or to reverse the moving direction of the object A.

The object A is further moved slightly in the right side direction together with the sliding shaft 3, and then the second stopping face 3*c* of the sliding shaft 3 abuts against the reference stopping face 2*a*.

In the condition as shown in FIG. 1, in case the space between the reference stopping face 2*a* and the second stopping face 3*c* is set as t1; the space between a right end of the right side shaft 3*d* of the sliding shaft 3 and the contact pin 7 is set as t2; and the space between the movable contact 8 and the fixed contact 12 is set as t3, the following relation is established.

$$t1>t2+t3$$

Thus, after the switch is actuated, the second stopping face 3*c* abuts against the reference stopping face 2*a*. Thus, the object A stops at the reference position.

Figure 3:
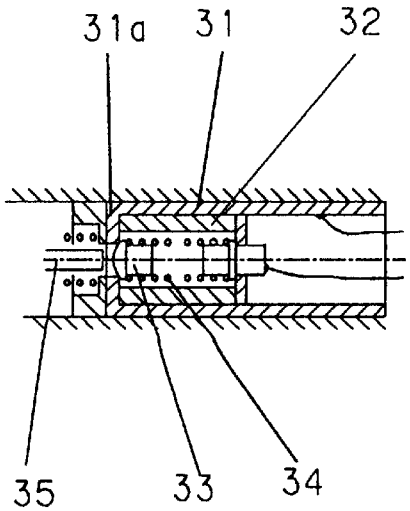
FIG. 3 is an enlarged front sectional view for showing an essential part of a switch or control signal generating device of a second embodiment of the invention.

The switch or control signal generating portion shown in FIG. 1 is of a constantly open contact system, i.e. contact system (a), while a control signal generating device shown in FIG. 3 is of a constantly closed contact system, i.e. contact system (b), wherein portions different from the contact system (a) are only shown.

More specifically, in FIG. 3, reference numeral 31 is a conductive cylinder; 32 is an insulating pipe; 33 is a movable contact slidably held inside the insulating pipe 32; and 34 is a compression coil spring which functions as a conductive wire to the movable contact 33 as well as allows the movable contact 33 to always contact a ring-shape fixed contact 31*a* at a left edge portion of the conductive cylinder 31.

An insulating sliding shaft 35 corresponds to the movable contact 8. When the sliding shaft 35 moves in the right direction according to the displacement of the sliding shaft 3 (refer to FIG. 1), the sliding shaft 35 pushes the movable contact 33 to thereby separate it from the ring-shape fixed contact 31*a* and to output an OFF signal.

Figure 4:
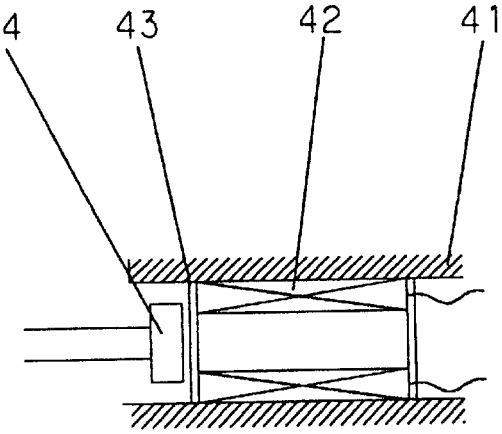
FIG. 4 is an enlarged front sectional view for showing an essential part of a non-contact type switch or control signal generating device of a third embodiment of the invention.
Figure 5:
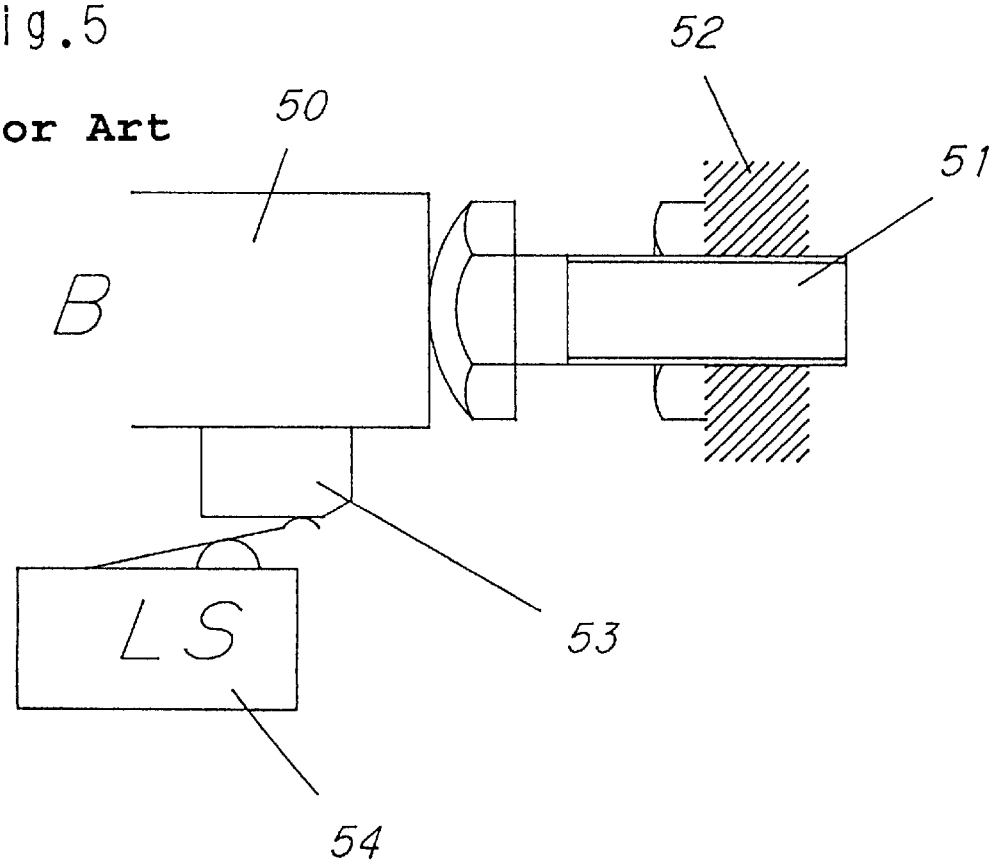
Fig.5 Prior Art
FIG. 5 shows a conventional positioning bolt.
Figure 6:
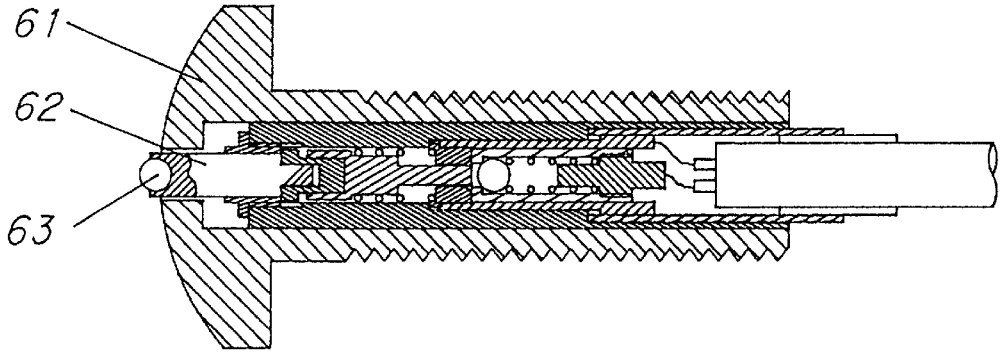
Fig.6 Prior Art
FIG. 6 is a front sectional view of a positioning bolt of another conventional positioning bolt.

FIG. 4 shows a front sectional view taken at a front center of a control signal generating device of a non-contact system of a third embodiment according to the present invention, wherein a bobbin 43 wound with a coil 42 is situated in a hole provided in a bolt body 41, and a magnetic core 44 corresponding to the movable contact 8 shown in FIG. 1 is provided close to a left edge of the bobbin 43.

While an alternating current is being supplied to the coil 42, when the magnetic core 44 further approaches the left edge of the bobbin 43 according to a movement of the sliding shaft 3 (FIG. 1), the alternating current is changed according to a change of inductance of the coil 42. By detecting the changed current, a control circuit is operated.

Also, the control circuit may be operated by detecting a change of an amount of light received by a light receiving element for receiving light emitted from a light-emitting diode according to displacement of a sliding shaft corresponding to the sliding shaft 8 shown in FIG. 1.

The invention is not limited to the embodiments as described above provided that it does not exceed the scope of the present invention.

In the invention, since the waterproof device formed of a rubber cylindrical cover for covering the second stopping face of the sliding shaft and the reference stopping face is provided, the sliding operation of the sliding shaft can be smoothly performed. Also, it is possible to provide complete waterproof from the bearing portion of the sliding shaft to the control signal generating device.

In the invention, the object to be detected does not directly hit the head of the bolt, and indirect stopping surfaces are provided as the second stopping face and the reference stopping face so that surfaces for receiving abutting force become wider. Therefore, there is no risk that breaking and deformation take place in the bolt.

In case the switching portion or control signal generating device is to be exchanged, the bolt body need not be removed from a work station. When the cable fixture is removed from the female thread of the bolt hole, the switching portion can be completely removed, so that the switching portion can be easily exchanged. In this respect, if the bolt body is removed from the work station to repair the switching portion, it takes time to set the reference stopping face when the bolt body is fixed again.

While the invention has been explained with reference to the specific embodiments of the invention, the explanation is illustrative and the invention is limited only by the appended claims.

What is claimed is:

1. A stopping device with a switch, comprising:

a bolt having a bolt through hole therein;

a head portion attached to the bolt and having a first stopping face and a head through hole communicating with the bolt through hole;

a control signal generating device situated in the bolt through hole of the bolt, said control signal generating device including a fixture fixed to the bolt at a side away from the head portion; an insulation cylinder situated in the bolt through hole adjacent the fixture; a switch mechanism situated in the insulation cylinder, said switch mechanism having an actuator slidably situated inside the insulation cylinder, a movable contact situated inside the insulating cylinder and attached to the actuator, an electrically conductive cylinder situated inside the insulation cylinder and attached to one lead, a fixed contact situated inside the conductive cylinder without contacting the conductive cylinder and attached to the other lead, and an annular member made of an insulating material and fixed to the conductive cylinder; and an electrically conductive member for connecting the conductive cylinder to the movable conduct to actuate the switch mechanism as a normal open switch;

a sliding member including a shaft slidably situated in the head through hole and contacting the actuator, a flange attached to the shaft and having a second stopping face facing the first stopping face, and an end portion extending from the flange for contacting an object to be detected so that until the second stopping face abuts against the first stopping face after the object contacts the end portion, the control signal generating device produces a control signal;

a spring device situated between the insulation cylinder and the sliding member to urge the sliding member away from the head portion so that when the object to be detected abuts against the sliding member, abutting force thereof is transmitted to the switch mechanism; and a sealing device including a cylindrical elastic member having a first end attached to the head portion and a second end attached to the sliding member for sealing between the head portion and the sliding member.

2. A stopping device with a switch according to claim 1, wherein said sealing device further includes a cylindrical cover situated over the head portion to securely hold the first end between the head portion and the cover, and a stopper attached to the sliding member near the end portion for holding the second end between the flange and the stopper.

3. A stopping device with a switch according to claim 2, wherein said first and second ends of the cylindrical elastic member have thicknesses greater than a middle portion between the first and second ends so that the first and second ends are sealingly fixed to the head portion and the sliding member.

4. A stopping device with a switch according to claim 3, wherein said head portion is separately formed with the bolt, and has an annular groove, into which said first end of the cylindrical elastic member is disposed.

5. A stopping device with a switch, comprising:

a bolt having a bolt through hole therein;

a head portion attached to the bolt and having a first stopping face and a head through hole communicating with the bolt through hole;

a control signal generating device situated in the bolt through hole and including an insulation cylinder situated in the bolt through hole, an actuator slidably situated inside the insulation cylinder and having a head side end located at a side near the head portion, a movable contact situated inside the insulation cylinder and attached to the actuator at a side opposite to the head side end, an electrically conductive cylinder situated inside the insulation cylinder near the actuator, and a fixed contact situated inside the conductive cylinder to form a space between the movable contact and the fixed contact;

a sliding member including a shaft slidably situated in the head through hole to form a space between the shaft and the head side end of the actuator, a flange attached to the shaft and having a second stopping face facing the first stopping face to form a space between the first and second stopping faces, which is greater than a sum of the space between the movable contact and the fixed contact and the space between the shaft and the head side end, and an end portion extending from the flange for contacting an object to be detected so that until the second stopping face abuts against the first stopping face after the object contacts the end portion, the movable and fixed contacts contact together to produce a control signal;

a spring device attached to the sliding member to urge the sliding member away from the head portion; and a sealing device including a cylindrical elastic member having a first end attached to the head portion and a second end attached to the sliding member for sealing between the head portion and the sliding member.

6. A stopping device with a switch according to claim 5, wherein said head portion includes an annular groove in which the first end of the elastic member is disposed, and said sealing device further includes a cylindrical cover situated over the head portion to securely hold the first end between the head portion and the cover, and a stopper attached to the sliding member near the end portion for holding the second end in an axial direction of the shaft between the flange and the stopper, said first and second ends of the cylindrical elastic member having thicknesses greater than a middle portion between the first and second ends so that the first and second ends are sealingly fixed to the head portion and the sliding member.

7. A stopping device with a switch according to claim 6, wherein said flange has at a side opposite to the second stopping face a radial length greater than that of the second end of the elastic member so that when the second end of the elastic member is attached to the sliding member, the second end is urged entirely toward the flange to be securely retained between the stopper and the flange.

* * * * *